US009334672B1

(12) United States Patent
Mallory

(10) Patent No.: US 9,334,672 B1
(45) Date of Patent: May 10, 2016

(54) BRACKET FOR HANGING A RAIL AND METHOD

(71) Applicant: Scott Robert Mallory, Auburn, WA (US)

(72) Inventor: Scott Robert Mallory, Auburn, WA (US)

( * ) Notice: Subject to any disclaimer, the term of this patent is extended or adjusted under 35 U.S.C. 154(b) by 246 days.

(21) Appl. No.: 13/872,094

(22) Filed: Apr. 27, 2013

(51) Int. Cl.
*E04H 17/00* (2006.01)
*E04H 17/14* (2006.01)
*E04B 1/26* (2006.01)

(52) U.S. Cl.
CPC ..... *E04H 17/1421* (2013.01); *E04B 1/2608* (2013.01); *E04H 17/14* (2013.01); *E04H 17/143* (2013.01); *E04B 2001/2648* (2013.01)

(58) Field of Classification Search
CPC ..... E04H 17/1421; E04H 17/143; E04H 17/1434; E04H 2017/146; E04B 2001/2636; E04B 2001/2648; E04B 1/2608; E04B 2001/2628
USPC ..... 256/65.03, 65.08
See application file for complete search history.

(56) References Cited

U.S. PATENT DOCUMENTS 2,627,616 A * 2/1953 Lasting ..... F16B 12/60 5/296
2,720,289 A * 10/1955 Henrickson ..... E04B 5/10 16/87.2
3,276,797 A * 10/1966 Humes, Jr. ..... 52/715
3,601,428 A * 8/1971 Gilb ..... E04B 1/2608 248/217.3
4,068,332 A * 1/1978 Ball et al. ..... 5/296
4,398,841 A * 8/1983 Kojima ..... E04B 1/2604 403/173
4,503,652 A * 3/1985 Turner ..... 52/657
4,854,107 A * 8/1989 Roberts ..... E04B 1/943 52/834
5,577,856 A * 11/1996 Tezuka ..... 403/294
5,598,680 A * 2/1997 Wilhelmi ..... E04B 1/2608 248/300
5,617,694 A * 4/1997 Baba ..... 52/712
5,896,721 A * 4/1999 Sugiyama ..... 52/712
5,966,892 A * 10/1999 Platt ..... 52/712
6,032,431 A * 3/2000 Sugiyama ..... E04B 1/2604 403/230
6,474,902 B1 * 11/2002 Beauvoir ..... E04B 1/2403 403/187
6,536,179 B2 * 3/2003 Little ..... E04B 1/2608 403/230
6,698,971 B1 * 3/2004 Wilhelmi ..... 403/403
6,837,019 B2 * 1/2005 Collie ..... 52/712
7,251,918 B2 * 8/2007 Reif et al. ..... 52/714
7,497,054 B2 * 3/2009 Takeuchi ..... E04B 1/2403 403/403
7,726,635 B2 * 6/2010 Heard ..... 256/48
8,443,561 B2 * 5/2013 Ceccotti et al. ..... 52/285.2
2008/0286038 A1 * 11/2008 Ogden et al. ..... 403/300
2010/0288989 A1 * 11/2010 Williams ..... E04H 17/143 256/59

* cited by examiner

*Primary Examiner* — Daniel P Stodola
*Assistant Examiner* — Matthew R McMahon
(74) *Attorney, Agent, or Firm* — Joseph Z. Ellsworth

(57) ABSTRACT

The invention may relate to a bracket that is used in building fences or floor joists or the like. The bracket is substantially concealed from view after assembly. The invention may also be a method for building fences involving a bracket that is concealed from view after the fence is completed.

13 Claims, 5 Drawing Sheets

BRACKET FOR HANGING A RAIL AND METHOD

FIELD OF THE INVENTION

This invention may relate to fixtures for building fences or setting floor joists and the like. This invention also relates to the method of building a fence wherein the apparatus attaching the rails to the post is hidden from view.

BACKGROUND

Households have long used fences to demarcate property lines, to exclude others and to maintain privacy. Fences can add value to a residential home based on appearance and function. It is known in the art to put posts into the ground as the main structural support for a fence. It is also known to put a rail from post to post to further support the fence. Pickets can be hung from this structure or it can be covered in wire mesh.

In the case of privacy fences, cedar planks are attached to rails and are spaced closely to limit the view through the fence. These fences have the planks overlap the posts or butt up right next to the post. For years the only solution was to have a joist hanger that would wrap under the rail and attach to the post. This is unsightly and limits how close the planks or pickets can be to the post. It is therefore desirable to hide the means for attaching the rail to the post. It is also desirable to have the attachment means be below the attachment surface of the rail.

SUMMARY

The deficiencies in the art have been satisfied after a long felt need. An embodiment of the current invention is a bracket that can be used to attach rails to posts without being seen or without extending beyond the attachment side of the rail. This solution was not obvious because it may require a cut in the rail along its length to fit the bracket within the rail. The bracket may be attached to the posts at the appropriate height and then the rail with a slit cut along its length is slid down over the brackets protruding flange. The bracket has a plurality of slots at known distances on the protruding flange through which fasteners penetrate and attach the rail to the bracket. Another exemplary feature of the invention is alignment notches along the attachment flange which allow a builder to know where the plurality of slots are because the notches line up with the slots and can be seen with the rail in place. Additionally, a secondary or tertiary flange may extend perpendicular to the attachment flange or protruding flange to allow a rail to sit in place while it is fastened. Alternatively a distal bulge slightly larger than the slit in the rail will cause friction to hold the rail in place while it is fastened. This bracket allows all flanges of the bracket to be hidden in the rail or between the rail and the post. All fasteners can be sunk flush to the surface so all panels, planks or pickets sit flush and can be placed where ever the builder desires.

DETAILED DESCRIPTION OF THE PREFERRED EMBODIMENT

Figure 1:
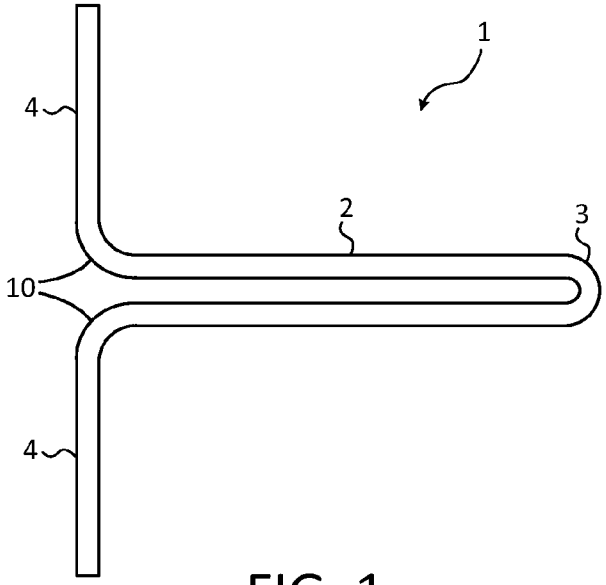
FIG. 1 is a top view of one embodiment of the bracket.

The rail hanger 1 comprises a first flange 2 that protrudes away from two attachment flanges 4. The distal end 3 of the first flange may be narrow or may have a distal bulge 9 to temporarily secure a rail 12 in place while permanent rail fasteners 17 are inserted. One of the major advantages of the rail hanger 1 may be that it is easily manufactured by making bends at the distal end 3 and at the attachment flange bends 10. Another embodiment may have a lower bend 26 where the first flange 2 is manufactured from a single sheet of material and the attachment flanges 4 are folded away from the first flange.

Referring to FIG. 1; the rail hanger 1 has a first flange 2 that protrudes away from the attachment flange 4. The first flange 2 consists of two pieces of material folded back adjacent to each other.

Figure 2:
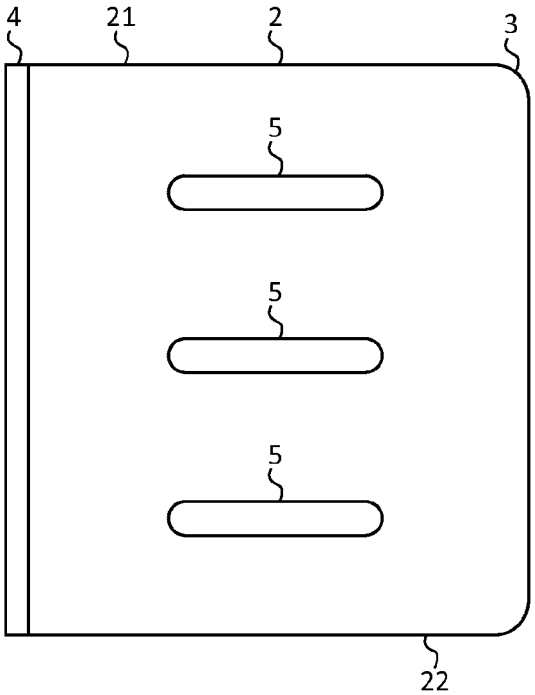
FIG. 2 is a side view of the bracket of FIG. 1.

Referring to FIG. 2; the rail hanger 1 may have rail apertures 5 which may be in the form of slots or holes. The rail aperture is placed at a known distance to allow blind installation of rail fasteners 17. Slots would allow variation in rail fastener 17 placement in the lengthwise direction of a rail 12. The slots would still bear load in the vertical direction which is the primary loading of a rail 12.

Figure 3:
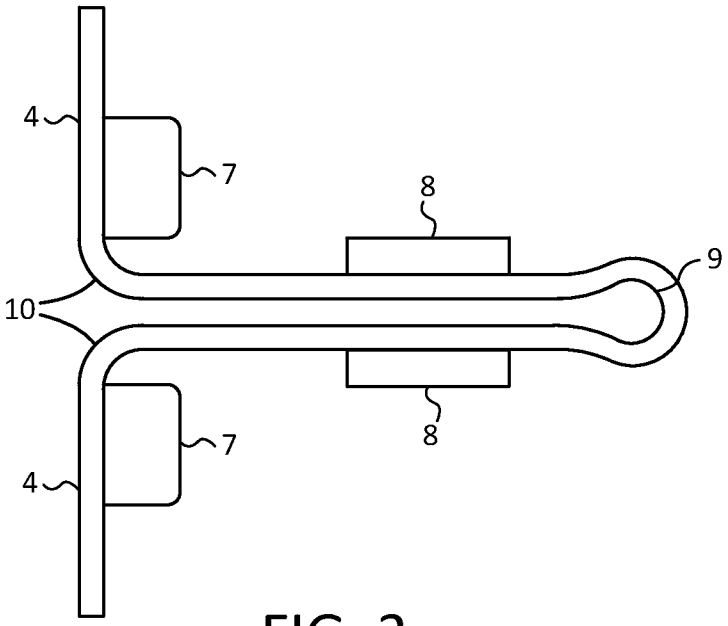
FIG. 3 is a top view of another embodiment of the bracket.

Referring to FIG. 3; the rail hanger 1 has an attachment flange 4 that may have a secondary flange 7 protruding perpendicular outward. The first flange 2 may have a tertiary flange 8 protruding perpendicular outward from the first flange 2. The secondary flange 7 and tertiary flange 8 may either or both be on a rail hanger 1 to support a rail 12 while the rail fasteners 17 are installed.

Figure 4:
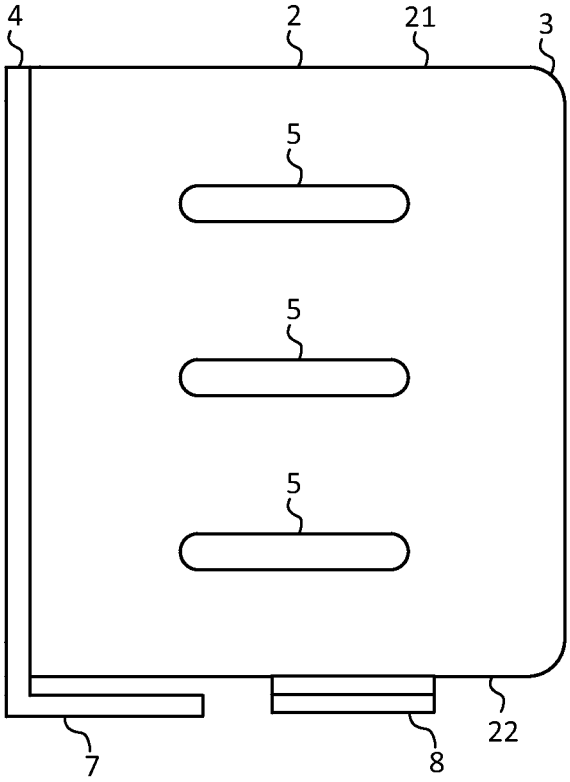
FIG. 4 is a side view of the bracket of FIG. 3

FIG. 4 shows the rail apertures 5 through the first flange 2.

Figure 5:
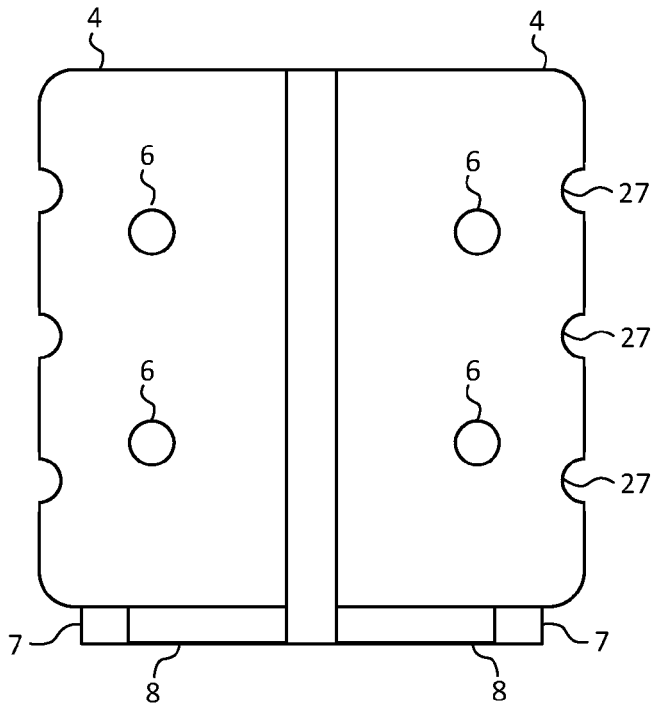
FIG. 5 is a front view of the bracket of FIG. 3 and similar to the embodiment in FIG. 1.

Referring to FIG. 5; the rail hanger 1 comprises post attachment apertures 6 wherein fasteners attach the rail hanger 1 to a post 14.

Figure 6:
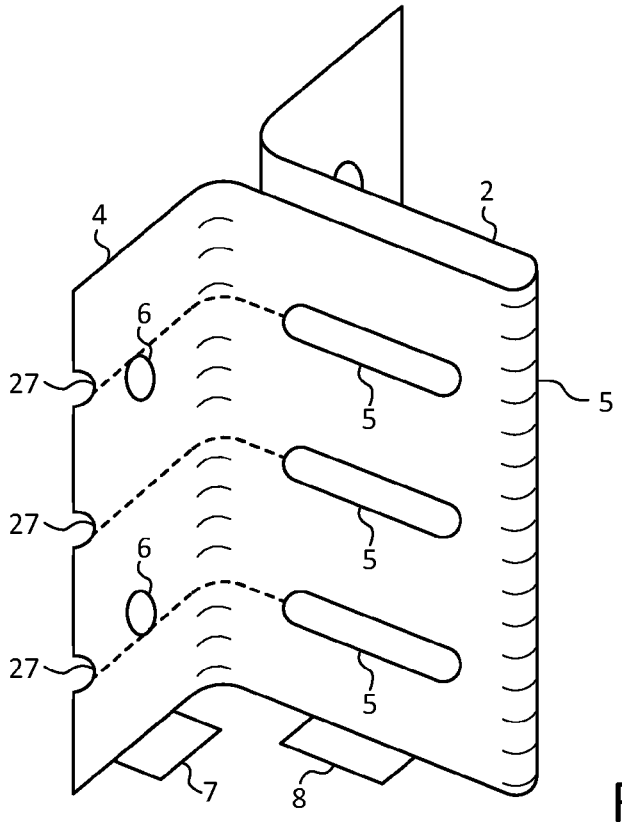
FIG. 6 is a perspective view of the bracket of FIG. 3 and is similar to the bracket in FIG. 1.

Referring to FIG. 6; the isometric view of a rail hanger shows the relationship of the alignment notches 27 and the rail apertures 5. The alignment notches 27 can be seen while the rail 12 is in place. A builder can align a rail fastener 17 with the alignment notch 27 and be confident that the rail fastener 17 will clear the rail aperture 5 and continue into the rail 12. This allows builders to quickly fasten the rail 12 to the rail hanger 1 without taking measurements and avoiding costly rework.

Figure 7:
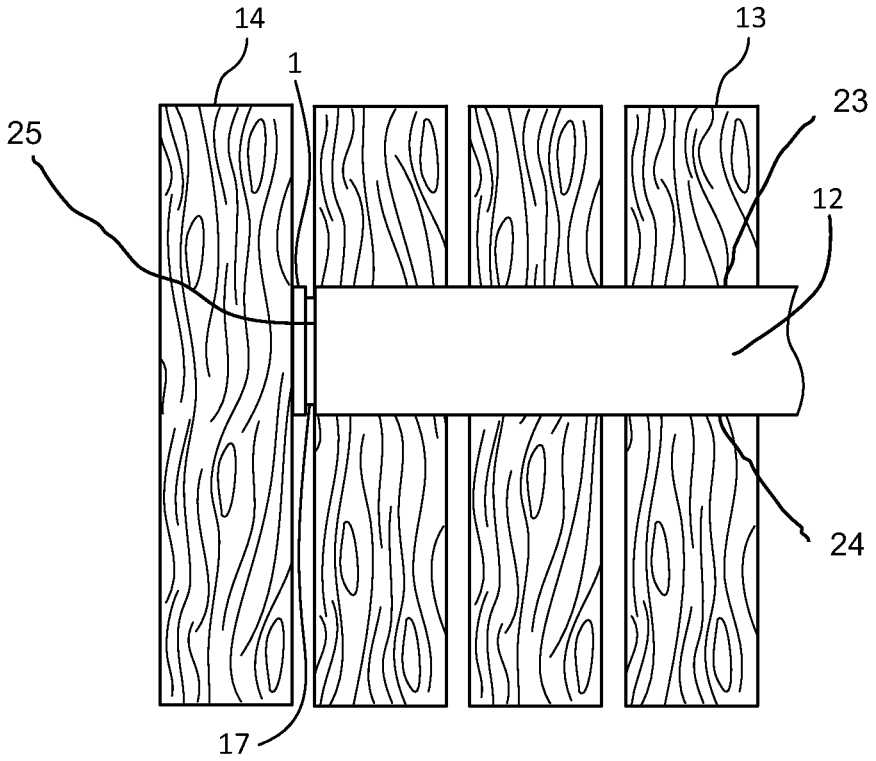
FIG. 7 is a perspective view of one embodiment of the invention wherein a bracket is used in a fence.

Referring to FIG. 7; a fence is constructed using a post 14 attached to a rail 12 using a rail hanger 1. The gap between the rail 12 and post 14 is exaggerated to show the rail hanger 1. Rail fasteners 17 are installed through the rail 12 and through the rail apertures 5. Pickets 13 or planks are attached to the rail 12 and may be attached adjacent to the post 14 without interference with the rail hanger 1. The rail hanger 1 is hidden on the back side of the fence and can only be seen through a small gap.

Figure 8:
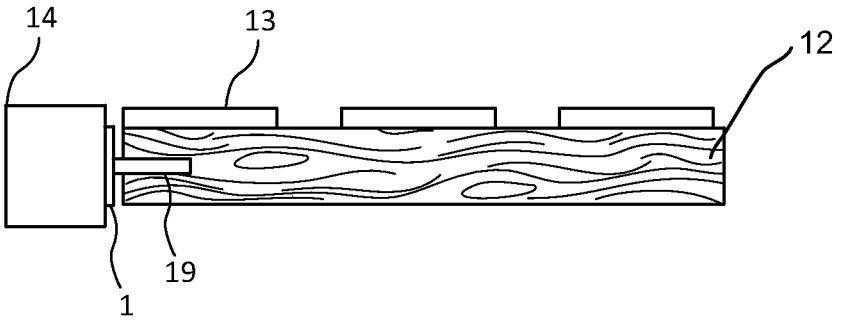
FIG. 8 is a top view of the fence in FIG. 7.

Referring to FIG. 8; a rail 12 has a rail slit 19 extending along the length of the rail 12 through which the rail hanger 1 extends.

Figure 9:
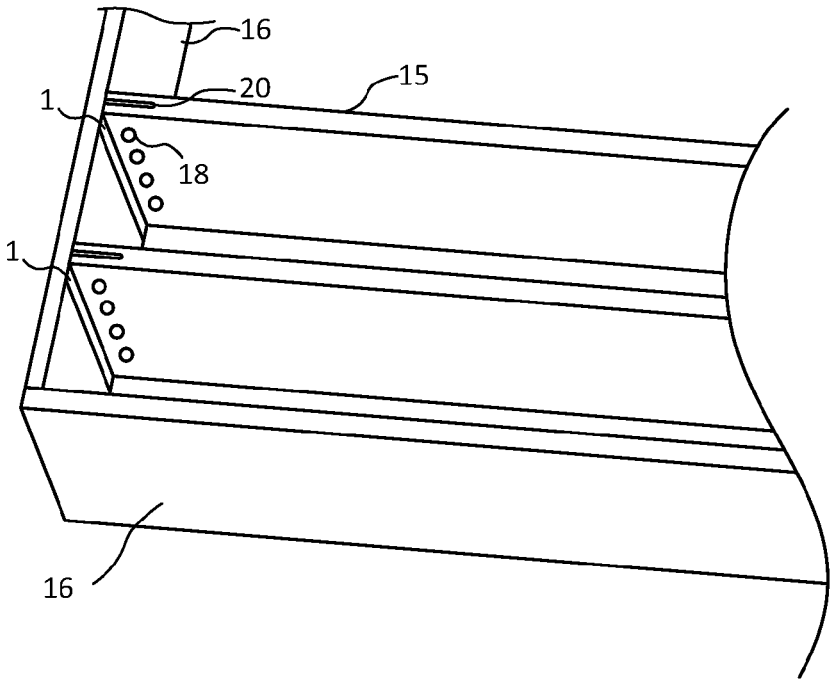
FIG. 9 is a perspective view of an embodiment of the invention wherein the bracket is used to hang floor joists.
Figure 10:
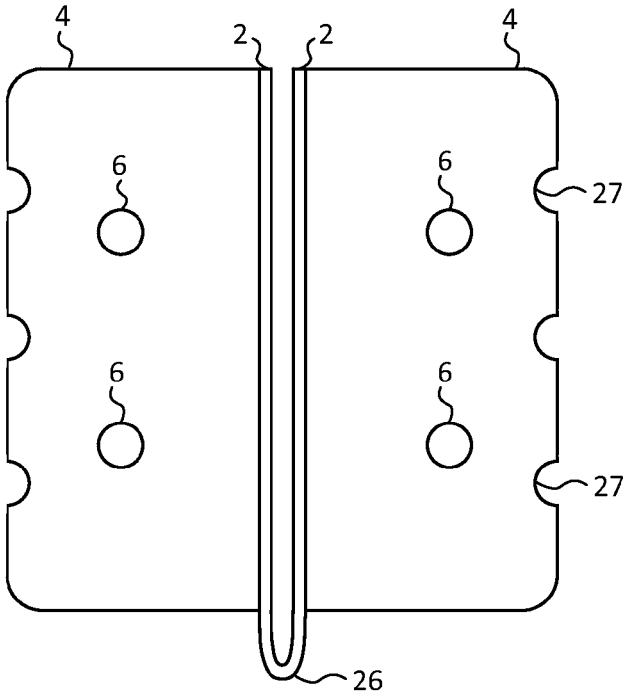
FIG. 10 is a front view of an embodiment of the invention.

Referring to FIG. 9; a rail hanger 1 extends into a floor joist 15 through a joist slit 20 cut into the floor joist 15. Joist fasteners 18 extend through the joist 15 and the rail hanger 1. The rail hanger is fastened to the band 16 and load from the joists 15 is transferred into the band 16. The rail hanger 1 may made from a material that is folded to shape. A preferred embodiment may be a galvanized or stainless steel approximately one sixteenth of an inch (1/16") thick. This allows the rail hanger 1 to fit into a rail slit 19 or joist slit 20 that is one eighth of an inch (1/8") or the standard blade width of a circular saw cut. The material for the rail hanger 1 may be galvanized steel, stainless steel, aluminum, copper, plastic or wood. The material thicknesses may be preferably 0.005" to 0.1." The slit width 19, 20 may be preferably 0.010" up to 0.200" and from 1 inch up to 4 inches deep from end of rail 25. The distance from top of first flange 21 to bottom of first flange 22 is approximately the width of the board used as the rail 12. For rough 2×4" boards this distance would be just less than 4 inches. For rough 2×8" joists this distance would be approximately under 8 inches. Finished board are one half inch smaller in each dimension. This distance could feasibly range from one inch to sixteen inches.

The method of making a fence comprises putting posts 14 in post holes. Rails 12 are cut to length to fit between posts 14. Slits 19 are cut through the center of the rails 12 from rail top 23 to rail bottom 24 to a depth of up to 2 inches from end of rail 25. A rail hanger 1 is fastened to the posts 14 using fasteners through post attachment apertures 6 at a desired height. The rails 12 are put in place with the rail hanger first flange 2 within the slit 19 in the rail 12. Rail fasteners 17 are fastened through the rail 12 and rail hanger 1. The rail fasteners are aligned using the alignment notches 27 which are visible after a rail 12 is put in place. Pickets or planks 13 are fastened to the rail 12.

I claim:

1. A bracket for hanging rails comprising, a first flange protruding away from two attachment flanges, the first flange comprising a first plate-like portion and a second plate-like portion connected at a folded end, the first flange further comprising at least one rail aperture in the form of a slot having constant width, wherein each rail aperture comprises a slot formed in the first plate-like portion aligned with a slot formed in the second plate-like portion such that the rail aperture extends entirely through the first flange, at least one alignment notch on an edge of at least one of said two attachment flanges, the number of alignment notches being equal to the number of rail apertures, and wherein each alignment notch is aligned with a corresponding rail aperture, each alignment notch being of, at most, the same width as the corresponding rail aperture and configured to allow blind installation of a rail fastener through said corresponding rail aperture when the corresponding rail aperture is concealed by a rail.

2. The bracket for hanging rails of claim 1 further comprising, a distal bulge at a distal end of the first flange configured to be larger than a slit in a rail and frictionally secure a rail in place while rail fasteners are inserted.

3. The bracket for hanging rails of claim 1 wherein, the bracket is one piece of material comprising a bend at a distal end and attachment flange bends.

4. The bracket for hanging rails of claim 1 wherein, the at least one rail aperture allows for variation in rail fastener placement in a lengthwise direction of a rail and reacts load in a vertical direction.

5. The bracket for hanging rails of claim 1 further comprising, a secondary flange protruding perpendicular outward away from at least one of said two attachment flanges.

6. The bracket for hanging rails of claim 1 further comprising, a tertiary flange protruding perpendicular outward away from the first flange.

7. The bracket for hanging rails of claim 1 wherein, a secondary flange or a tertiary flange protrude from a rail hanger to support a rail while at least one rail fastener is installed.

8. The bracket for hanging rails of claim 1 further comprising, at least one post attachment aperture through at least one of said two attachment flanges, wherein fasteners attach the bracket to a post.

9. The bracket for hanging rails of claim 1 wherein, the bracket is one piece of material comprising a lower bend and attachment flange bends.

10. A structure comprising, a post, the post attached to a rail using a rail hanger, the rail hanger having a first flange protruding away from two attachment flanges, the first flange comprising a first plate-like portion and a second plate-like portion connected at a folded end, the first flange further comprising at least one rail aperture in the form of a slot having constant width, wherein each rail aperture comprises a slot formed in the first plate-like portion aligned with a slot formed in the second plate-like portion such that the rail aperture extends entirely through the first flange, at least one alignment notch on an edge of at least one of said two attachment flanges, the number of alignment notches being equal to the number of rail apertures, and wherein each alignment notch is aligned with a corresponding rail aperture, each alignment notch being of, at most, the same width as the corresponding rail aperture and configured to allow blind installation of a rail fastener through said corresponding rail aperture when the corresponding rail aperture is concealed by a rail, and a rail fastener installed through the rail and said at least one rail aperture the rail hanger extends within the slit.

11. The structure of claim 10 further comprising, at least one picket or plank attached to the rail adjacent to the post.

12. The structure of claim 10 further comprising, a rail slit extending along the length of the rail and, the rail hanger extends within the slit.

13. The structure of claim 10 wherein, the rail hanger extends into a floor joist through a joist slit cut into the floor joist, at least one joist fastener extends through the joist and the rail hanger and, the rail hanger is fastened to a band and load from the joist is transferred into the band.

* * * * *